US007744352B2

(12) United States Patent
Parr

(10) Patent No.: US 7,744,352 B2
(45) Date of Patent: Jun. 29, 2010

(54) METHOD FOR REMOVING FLUID FROM A WELL BORE

(75) Inventor: Thomas Earl Parr, Blackwell, TX (US)

(73) Assignee: Latigo Pipe and Equipment, Inc., Blackwell, TX (US)

( * ) Notice: Subject to any disclaimer, the term of this patent is extended or adjusted under 35 U.S.C. 154(b) by 0 days.

(21) Appl. No.: 12/397,080

(22) Filed: Mar. 3, 2009

(65) Prior Publication Data

US 2009/0169397 A1 Jul. 2, 2009

Related U.S. Application Data

(63) Continuation of application No. 11/209,523, filed on Aug. 23, 2005, now Pat. No. 7,497,667.

(60) Provisional application No. 60/604,203, filed on Aug. 24, 2004.

(51) Int. Cl.
*F04F 5/44* (2006.01)

(52) U.S. Cl. ..... 417/198; 417/76; 417/77; 417/151; 417/904

(58) Field of Classification Search ..... 417/151, 417/108, 76, 77, 198, 904
See application file for complete search history.

(56) References Cited

U.S. PATENT DOCUMENTS 3,289,609 A * 12/1966 Palo ..... 417/54
3,718,407 A * 2/1973 Newbrough ..... 417/108
4,534,426 A * 8/1985 Hooper ..... 175/65
4,664,603 A * 5/1987 Priestly ..... 417/172
5,033,545 A * 7/1991 Sudol ..... 166/312
5,080,560 A * 1/1992 LeRoy et al. ..... 417/172
6,209,641 B1 * 4/2001 Stevenson ..... 166/266
6,685,439 B1 * 2/2004 Harrell et al. ..... 417/151
2002/0139525 A1 * 10/2002 Erick ..... 166/68
2005/0121191 A1 * 6/2005 Lambert et al. ..... 166/265

* cited by examiner

*Primary Examiner*—Devon C Kramer
*Assistant Examiner*—Christopher Bobish
(74) *Attorney, Agent, or Firm*—Dunlap Codding, P.C.

(57) ABSTRACT

A jet pump assembly and method for removing fluid from a well bore extending into a formation is disclosed. The jet pump assembly includes a jet pump interposed between a tubing string and a packer. The jet pump includes a body having an outer surface, a lower tubular end, an upper tubular end connected to a lower end of the tubing string, and a central axial bore intersecting the upper tubular end at a discharge end and extending partially through the pump body toward the lower tubular end. The pump body further has a plurality of radial inlet ports intersecting the central axial bore and a plurality of production ports extending from the lower tubular end to the upper tubular end in a non-intersecting relation to the injection ports. The central axial bore is shaped to provide a non-restricted flow path from the point the injection ports intersect the central axial bore to the discharge end of the central axial bore.

6 Claims, 2 Drawing Sheets

METHOD FOR REMOVING FLUID FROM A WELL BORE

CROSS REFERENCE TO RELATED APPLICATIONS

This application is a continuation of U.S. Ser. No. 11/209,523, filed Aug. 23, 2005, now U.S. Pat. No. 7,497,667 which claims benefit of U.S. Provisional Application No. 60/604,203, filed Aug. 24, 2004, both of which are incorporated herein by reference in their entirety.

BACKGROUND OF THE INVENTION

1. Field of the Invention

The present invention relates generally to an apparatus and method for artificially lifting fluid from a well bore, and more particularly, but not by way of limitation, to an improved method for supplying gas into a well bore to remove fluid therefrom.

2. Brief Description of Related Art

Various types of techniques and apparatus have previously been employed to purge fluid from a well bore. The techniques and apparatus selected depend on the condition of the well, such as well pressure, well depth, volume of fluids produced, availability of energy, equipment cost, and other factors.

Typical of such techniques and apparatus that have been employed to remove fluid from the well bore are submersible pumps, sucker rod pumps, gas lifts, and jet pumps. Although each of these techniques and apparatus have been effective in removing fluid from the well bore, such prior art techniques and apparatus have certain negative aspects. For example, when employing submersible pumps and sucker rod pumps to remove fluid from a well bore, the installation cost of such equipment is extremely high, thereby making the use of such equipment cost ineffective for lifting relatively small volumes of fluid. Further, submersible pumps and sucker rod pumps require frequent and time consuming maintenance.

The apparatus and techniques of employing a gas lift to remove fluid from the well bore are generally less expensive than the use of a submersible pump or a sucker rod pump. A gas lift is a mechanical process in which gas is used as the lifting medium to remove the fluid from the well bore. Gas is injected down the annulus of the well bore to a gas lift valve disposed in the tubing. The gas enters the tubing through the gas lift valve and lifts the fluid accumulated above the gas lift valve to the surface.

Like submersible pumps and sucker rod pumps, gas lift systems are expensive to install thereby making the use of such equipment cost ineffective for lifting relatively small volumes of fluid. Further, while maintenance costs are generally less than those of submersible pumps and sucker rod pumps, gas lift systems, particularly the gas lift valves, require time consuming maintenance.

Hydraulic or downhole jet pumps have previously been employed to remove fluid from a well bore. Hydraulic or downhole jet pumps generally include a power fluid line operably coupled to the entrance of the jet pump and a return line coupled to receive fluids from a discharge end of the pump. The jet pump includes a venturi or an area of constricted flow. As the pressurized power fluid is forced through the venturi of the downhole jet pump, the power fluid draws in and intermixes with the production fluid. The power fluid and production fluid are then pumped to the surface through the return line where the production fluid and the power fluid are recovered. Jet pumps are often advantageous because they generally involve substantially fewer moving parts than mechanical pumps, thereby increasing the reliability of the jet pump. However, because the flow of the fluid through the jet pump is restricted, the volume of fluid that the jet pump is capable of moving to the surface is also restricted. Furthermore, the restricted flow path creates a high volume environment which may result in damage to tubulars, such as the casing. Finally, the restricted flow path is susceptible to becoming clogged by fines and scale, thus requiring the jet pump to be pulled from the well bore.

Thus, a need exists for an improved jet pump assembly and method to remove accumulated fluid from a well bore. However, such an improved assembly and method must also be cost efficient and substantially maintenance-free. It is to such an improved apparatus and method that the present invention is directed.

DETAILED DESCRIPTION OF THE INVENTION

Figure 1:
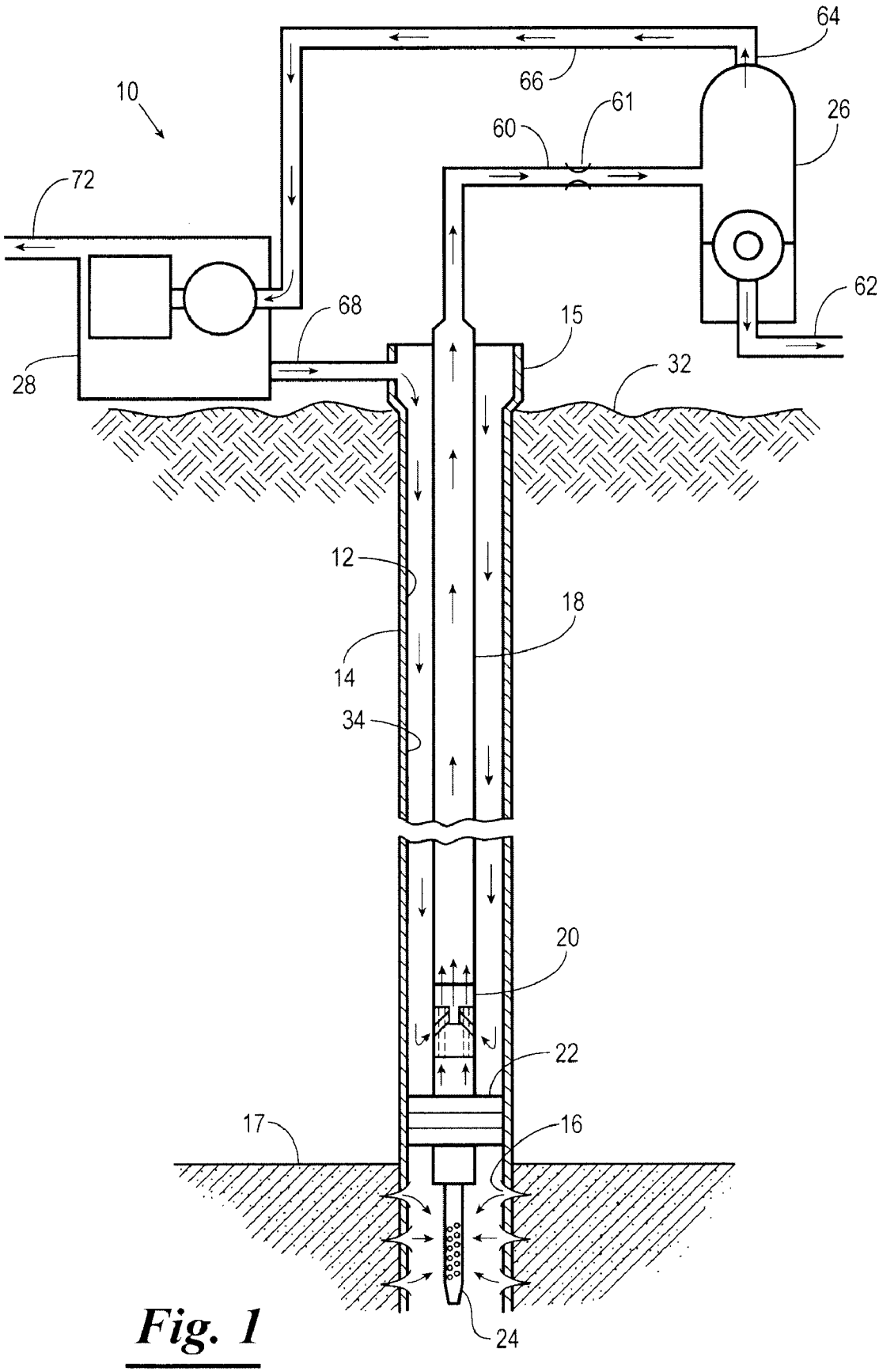
FIG. 1 is a schematic illustration, partially in cross section, of a jet pump assembly for removing fluid from a well bore constructed in accordance with the present in invention.

Referring now to FIG. 1, a jet pump assembly 10 constructed in accordance with the present invention for removing fluid, such as oil and water from a well bore 12 is schematically illustrated. The well bore 12 is shown to be lined with a casing 14 extending down from a wellhead 15. The casing 14 provides a permanent borehole through which production operations may be conducted. The casing 14 is affixed in the well bore 12 in a conventional manner, such as by cement (not shown), and is provided with perforations 16 open to a producing subterranean formation 17.

The jet pump assembly 10 includes a tubing string 18, a jet pump 20, a packer 22, a strainer 24, a separator 26, and a compressor 28. The tubing string 18 provides fluid communication between the producing subterranean formation 17 and a surface 32 such that a reservoir fluid (not shown), for example oil and/or natural gas, is produced through the tubing string 18. The casing 14 and the tubing string 18 define an annulus 34 which also provides fluid communication through the well bore 12.

Figure 2:
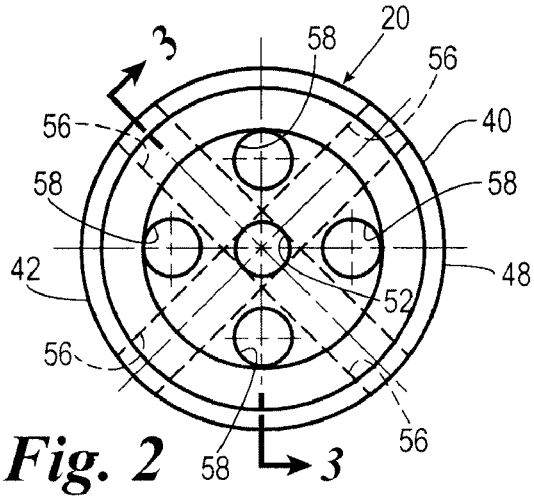
FIG. 2 is a top plan view of a jet pump constructed in accordance with the present invention.
Figure 3:
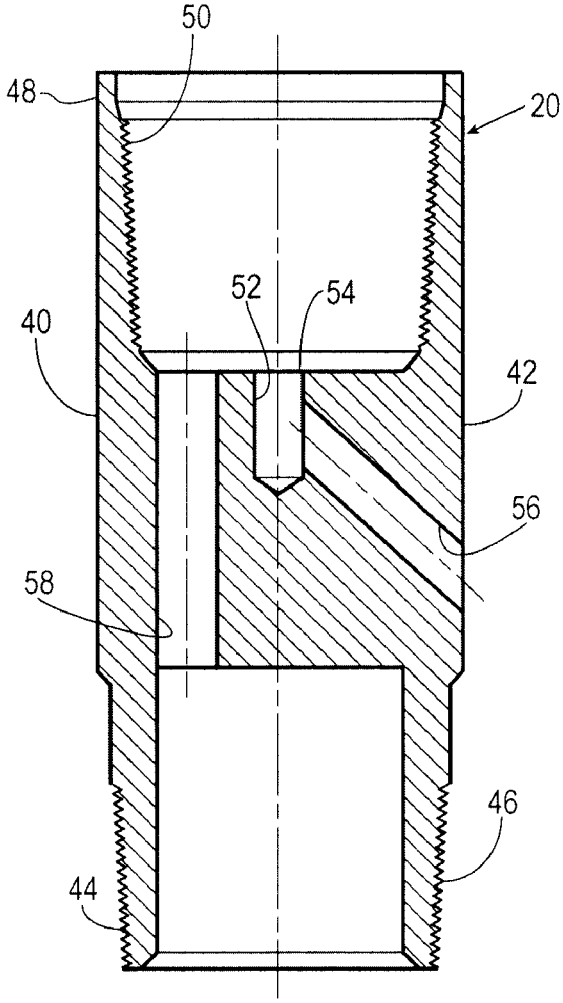
FIG. 3 is a rotated sectional view taken along line 3-3 of FIG. 2.

Referring now to FIGS. 2 and 3, the jet pump 20 is a one piece member and preferably machined from durable, rigid material, such as stainless steel. The jet pump 20 has a cylindrical pump body 40 having an outer surface 42, a lower tubular end 44 with an outer threaded surface 46, an upper tubular end 48 with an inner threaded surface 50, and a central axial bore 52. The central bore 52 intersects the upper tubular end 48 at a discharge end 50 so as to establish fluid communication with the upper tubular end 48 and extends partially through the pump body 40 toward the lower tubular end 44.

The pump body 40 further has a plurality of equally spaced, radial inlet ports 56 extending from the outer surface 42 of the pump body 40 and intersecting the central bore 52 a distance from the discharge end 54. In a preferred embodiment, the inlet ports 56 have a linear configuration along their entire length and extend upward from the outer surface 42 to the central bore 52 at an angle of from about 30 degrees to about 50 degrees to alleviate flow restriction. However, it will be appreciated that the inlet ports 56 may be formed at any angle.

The pump body 40 is further formed to have a plurality of production ports 58 which extend from the lower tubular end 44 to the upper tubular end 48 in a non-intersecting relation to the inlet ports 56 to establish fluid communication between the lower tubular end 44 and the upper tubular end 48. The production ports 58 are equally spaced and thus staggered between the inlet ports 56. While the jet pump 20 has been shown to have four inlet ports 56 spaced at 90 degree intervals and four production ports 58 spaced at 90 degree intervals, it will be appreciated that the number and position of the inlet ports 56 and production ports 58 may be varied.

To alleviate the restriction of fluid flow through the jet pump 20, the central bore 52 is formed to have a substantially uniform diameter from the point the inlet ports 56 intersect the central bore 52 to the discharge end 54 of the central bore 52. Moreover, it is preferred that the diameter of the central bore 52 be equal to or greater than the diameter of the inlet ports 56. By not restricting the flow of fluid through the inlet ports 56 and the central bore 52, the volume of fluid able to be passed through the jet pump 20 is increased relative to that which could be passed through the jet pump 20 if it included a nozzle or otherwise restricted flow path. Furthermore, by not restricting flow, the pressure exerted on the tubulars, such as the casing 14 and the tubing string 18, is greatly reduced. Finally, by eliminating the restricted flow path, the jet pump 20 is less susceptible to becoming clogged by fines and scale. If the jet pump 20 were to become clogged, the clog may generally be dislodged by applying a back pressure to the jet pump 20 with the use of a pumper truck at the surface, thus avoiding having to pull the tubing string 18, the jet pump 20, and the packer 22 from the well bore 12.

As illustrated in FIG. 1, the jet pump 20 is connected to the tubing string 18 in combination with the packer 22 and the strainer 24. The packer 22 is set below the fluid level of the well bore 12 and above the perforations 16 of the casing 14. The strainer 24 extends downwardly from the packer 22 into the production fluid.

In operation, compressed gas is injected into the annulus 34 formed between the casing 14 and the tubing string 18. The compressed gas forces the hydrostatic column of fluid above the packer 22 through the inlet ports 56 and the central bore 52 of the jet pump 20 and into the upper tubular end 48 and the tubing string 18 where the compressed gas mixes with the production fluid which has been pulled up through the production ports 58 by the compressed gas. The mixed fluids travel up the tubing string 18 to the surface 32.

At the surface 32, the fluid exits the tubing string 18 and is passed to a flow line 60 and is introduced into the fluid separator 26. The flow line 60 is provided with an adjustable choke 61 to control the flow of fluid through the jet pump assembly 10. When fluid begins entering the fluid separator 26, the jet pump assembly 10 reaches a break over point creating suction on the well bore 12. The depth of the well bore 12 and the height of the column of fluid in the well bore 12 dictate the gas pressure necessary to achieve break over and create suction. In general, 0.5 pounds of pressure per foot of fluid column to be lifted is required. Once break over point is achieved, discharge line pressure generally drops to 125 to 150 psi of working pressure. The fluid separator 26 separates the fluid into a gas portion and a liquid portion. The gas portion is discharged from the fluid separator 26. The liquid portion is discharged from the fluid separator 26 via a conduit 62 and is disposed of or further processed in a conventional manner depending on the makeup of the liquid portion.

The gas portion separated in the fluid separator 26 is discharged from the fluid separator 26 via a gas outlet 64. The gas portion is then passed to the compressor 28 via conduit 66. The gas is compressed in the compressor 28. The conduit 68 is provided with a check valve (not shown) and a ball valve (also not shown) to control the amount of gas injected down the annulus 34 which in turn is dictated by the volume of fluid in the well bore 12. A portion of the compressed gas is passed to the annulus 34 via the conduit 68. The other portion of the compressed gas is discharged from the compressor 28 as sales gas to a gas gathering network (not shown) via a conduit 72.

The jet pump assembly 10 provides a convenient, efficient and economical device for supplying and injecting a lift gas into the well bore 12 without having to transport gas from an off-well site, such as another well or a gas transmission pipeline. Further, the jet pump assembly 10 acts as a two-phase lifting system that utilizes bottom hole pressure and gas injection pressure to jet produced fluids to the surface. When the jet pump 20 is installed with the packer 22, the separator 26, and the compressor 28, the jet pump assembly 10 provides a closed system with no downhole moving parts. The jet pump assembly 10 allows for continuous or intermittent operation, reduces the need for workover operations, provides for lower operating expenses, and eliminates the need for expensive pump installations. Furthermore, the jet pump assembly 10 works in a wide range of depths of wells, straight wells or deviated well, and is tolerant of fines and scale.

From the above description it is clear that the present invention is well adapted to carry out the objects and to attain the advantages mentioned herein as well as those inherent in the invention. While a presently preferred embodiment of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A method for removing fluid from a well bore extending into a formation, comprising:

connecting a jet pump to a lower end of a tubing string, the jet pump comprising a pump body having an outer surface, a lower end, an upper end, and a central axial bore intersecting the upper end at a discharge end and extending partially through the pump body toward the lower end, the pump body further having a plurality of radial inlet ports extending from the outer surface of the pump body and intersecting the central axial bore and a plurality of production ports extending from the lower end to the upper end in a non-intersecting relation to the inlet ports, the central axial bore having a substantially uniform diameter from the point the inlet ports intersect the central axial bore to the discharge end of the central axial bore so that the central axial bore provides a non-restricted flow path from the inlet ports into the upper tubular end of the body;

positioning the tubing string and the jet pump in the well bore to form an annulus;

sealing the annulus below the inlet ports of the pump body in such a way that fluid communication is established between the formation and the production ports; and injecting a gas into the annulus so as to cause the gas to pass into the inlet ports of the body of the jet pump and through the central axial bore thereby causing fluid located below the lower end of the pump body to be lifted up through the production ports, mix with the gas, and be lifted up the tubing string to the surface.

2. The method of claim 1 further comprising:

connecting a separator to the tubing string such that fluid communication is established between the separator and the tubing string, the separator capable of separating the fluid lifted from the well bore into a gas portion and a liquid portion, the separator having a gas outlet; and connecting a compressor to the gas outlet of the separator such that fluid communication is established between the compressor and the separator, the compressor capable of compressing at least a portion of the gas portion to provide a compressed gas, the compressor connected to the annulus so as to establish fluid communication between the compressor and the annulus to permit the compressed gas to be conveyed to the annulus.

3. A method for removing fluid from a well bore extending into a formation and lined by a casing having perforations open to the formation, comprising:

connecting a jet pump to a lower end of a tubing string, the jet pump comprising a pump body having an outer surface, a lower end, an upper end, and a central axial bore intersecting the upper end at a discharge end and extending partially through the pump body toward the lower end, the pump body further having a plurality of radial inlet ports extending from the outer surface of the pump body and intersecting the central axial bore and a plurality of production ports extending from the lower end to the upper end in a non-intersecting relation to the inlet ports, the central axial bore having a substantially uniform diameter from the point the inlet ports intersect the central axial bore to the discharge end of the central axial bore so that the central axial bore provides a non-restricted flow path from the inlet ports to the upper end of the body;

positioning the tubing string and the jet pump in the well bore to form an annulus with the casing;

sealing the annulus below the inlet ports of the pump body and above the perforations in such a way that fluid communication is established between the formation and the production ports; and injecting a gas into the annulus so as to cause the gas to pass into the inlet ports of the body of the jet pump and through the central axial bore thereby causing fluid located below the lower end of the pump body to be lifted up through the production ports, mix with the gas, and be lifted up the tubing string to the surface.

4. The method of claim 3 further comprising:

connecting a separator to the tubing string such that fluid communication is established between the separator and the tubing string, the separator capable of separating the fluid lifted from the well bore into a gas portion and a liquid portion, the separator having a gas outlet; and connecting a compressor to the gas outlet of the separator such that fluid communication is established between the compressor and the separator, the compressor capable of compressing at least a portion of the gas portion to provide a compressed gas, the compressor connected to the annulus so as to establish fluid communication between the compressor and the annulus to permit the compressed gas to be conveyed to the annulus.

5. A method for removing fluid from a well bore extending into a formation and lined by a casing having perforations open to the formation, comprising:

connecting a jet pump to a lower end of a tubing string, the jet pump comprising a pump body having an outer surface, a lower tubular end, an upper tubular end, and a central axial bore intersecting the upper tubular end at a discharge end and extending partially through the pump body toward the lower tubular end, the pump body further having a plurality of radial inlet ports extending from the outer surface of the pump body and intersecting the central axial bore and a plurality of production ports extending from the lower tubular end to the upper tubular end in a non-intersecting relation to the inlet ports, the central axial bore having a substantially uniform diameter from the point the inlet ports intersect the central axial bore to the discharge end of the central axial bore so that the central axial bore provides a non-restricted flow path from the inlet ports to the upper tubular end of the body;

positioning the tubing string and the jet pump in the well bore to form an annulus with the casing;

sealing the annulus below the inlet ports of the pump body and above the perforations in such a way that fluid communication is established between the formation and the production ports; and injecting a gas into the annulus so as to cause the gas to pass into the inlet ports of the body of the jet pump and through the central axial bore thereby causing fluid located below the lower tubular end of the pump body to be lifted up through the production ports, mix with the gas, and be lifted up the tubing string to the surface.

6. The method of claim 5 further comprising:

connecting a separator to the tubing string such that fluid communication is established between the separator and the tubing string, the separator capable of separating the fluid lifted from the well bore into a gas portion and a liquid portion, the separator having a gas outlet; and connecting a compressor to the gas outlet of the separator such that fluid communication is established between the compressor and the separator, the compressor capable of compressing at least a portion of the gas portion to provide a compressed gas, the compressor connected to the annulus so as to establish fluid communication between the compressor and the annulus to permit the compressed gas to be conveyed to the annulus.

* * * * *